US005741019A

United States Patent [19]

Lu

[11] Patent Number: 5,741,019

[45] Date of Patent: Apr. 21, 1998

[54] DETACHABLE FRAME DEVICE FOR IN-LINE ROLLER SKATE

[76] Inventor: Jinny Lu, P. O. Box 55-1670, Taipei (104), Taiwan

[21] Appl. No.: 659,152

[22] Filed: Jun. 5, 1996

[51] Int. Cl.[6] ..... A63C 17/02

[52] U.S. Cl. ..... 280/11.22; 280/11.33; 301/5.3

[58] Field of Search ..... 280/7.13, 7.14, 280/11.22, 11.12, 11.18, 11.19, 11.23, 11.27, 11.3, 11.32, 11.34, 11.33, 11.115; 310/5.23, 5.3, 5.7

[56] References Cited

U.S. PATENT DOCUMENTS 475,650 5/1892 Wierda ..... 280/11.3

5,271,633 12/1993 Hill, Jr. ..... 301/5.7 X 5,507,506 4/1996 Shadroui ..... 280/11.27 X

*Primary Examiner*—Robert J. Oberleitner

*Assistant Examiner*—Pamela J. Lipka

[57] ABSTRACT

A detachable frame device includes: a rack device having a plurality of wheels linearly detachably mounted on the rack device, each wheel rotatably secured on the rack device by an axle device detachably secured on the rack device, a chassis secured to a boot or shoe of roller skate and pivotally secured to the rack device, and a locking device for locking the chassis with the rack device when each axle device is clamped in between the chassis and the rack device, whereby upon unlocking of the locking device to separate the chassis from the rack device, any one wheel can be removed from the rack device and replaced with a new one for conveniently dismantling the frame device and changing the wheels rotatably secured on the frame device.

10 Claims, 5 Drawing Sheets

DETACHABLE FRAME DEVICE FOR IN-LINE ROLLER SKATE

BACKGROUND OF THE INVENTION

A conventional in-line roller skate includes a plurality of wheels linearly mounted under a frame each wheel rotatably secured to the frame by an axle bolt. Whenever replacing a damaged or broken wheel, it is very inconvenient to dismantle the axle bolt in order to replace the damaged wheel by a new wheel. Meanwhile, it is also inconvenient to change the wheels for different wheel diameters for varying the heights of the roller skate to satisfy a player's personal specific requirements. For dismantling and changing the skate wheels, a professional tool and skill may be required, causing inconvenience for the player.

The present inventor has found the drawbacks of the conventional in-line roller skate and invented the frame device which is detachable for easily replacing wheels as rotatably secured on the frame device.

SUMMARY OF THE INVENTION

The object of the present invention is to provide a detachable frame device including: a rack device having a plurality of wheels linearly detachably mounted on the rack device, each wheel rotatably secured on the rack device by an axle device detachably secured on the rack device, a chassis secured to a boot or shoe of the roller skate and pivotally secured to the rack device, and a locking device for locking the chassis with the rack device when each axle device is clamped in between the chassis and the rack device, whereby upon unlocking of the locking device to separate the chassis from the rack device, one wheel can be removed from the rack device and replaced with a new one for conveniently dismantling the frame device and changing the wheels rotatably secured on the frame device.

DETAILED DESCRIPTION

Figure 1:
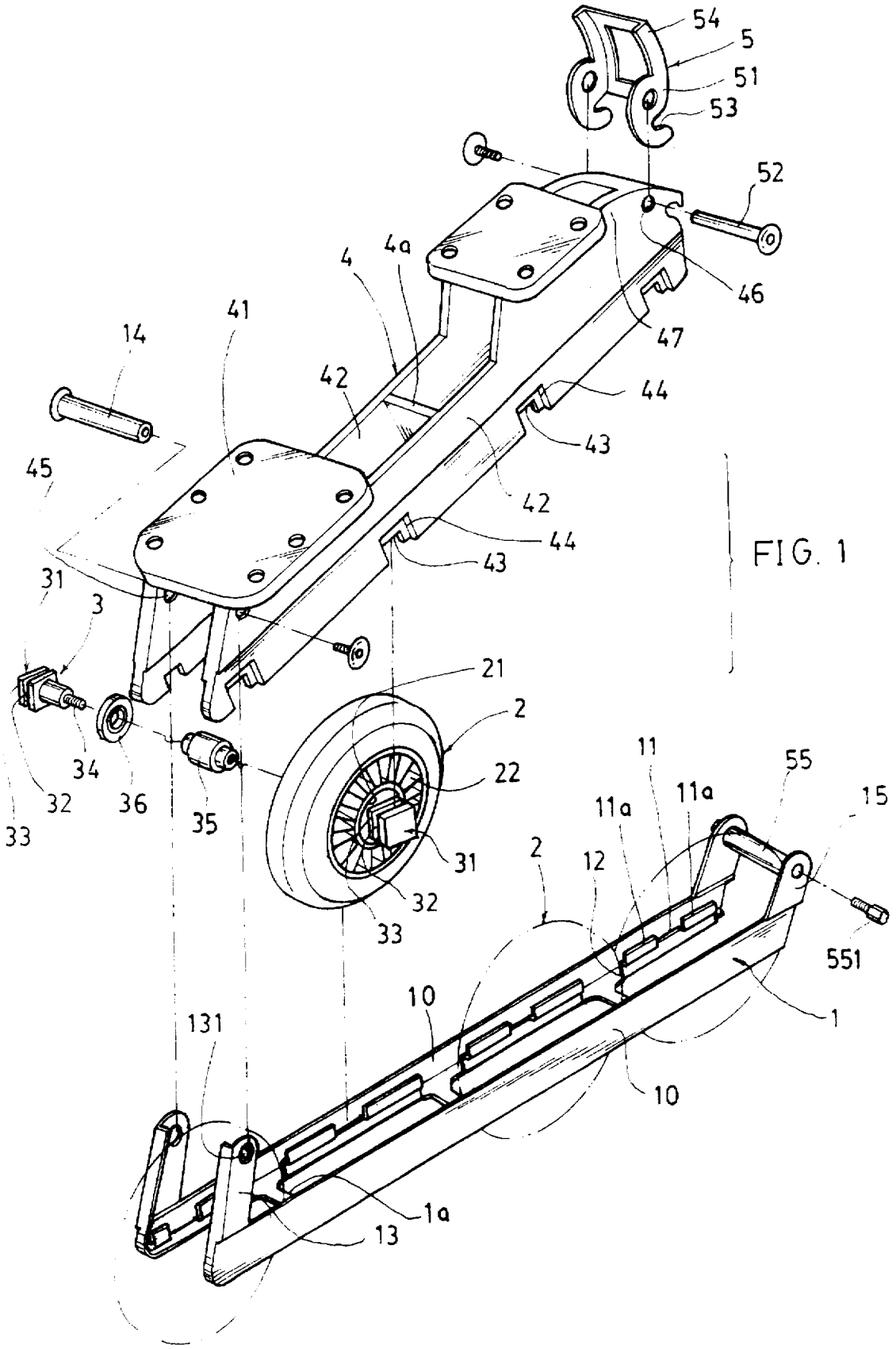
FIG. 1 is an exploded view showing the elements of the present invention.
Figure 2:
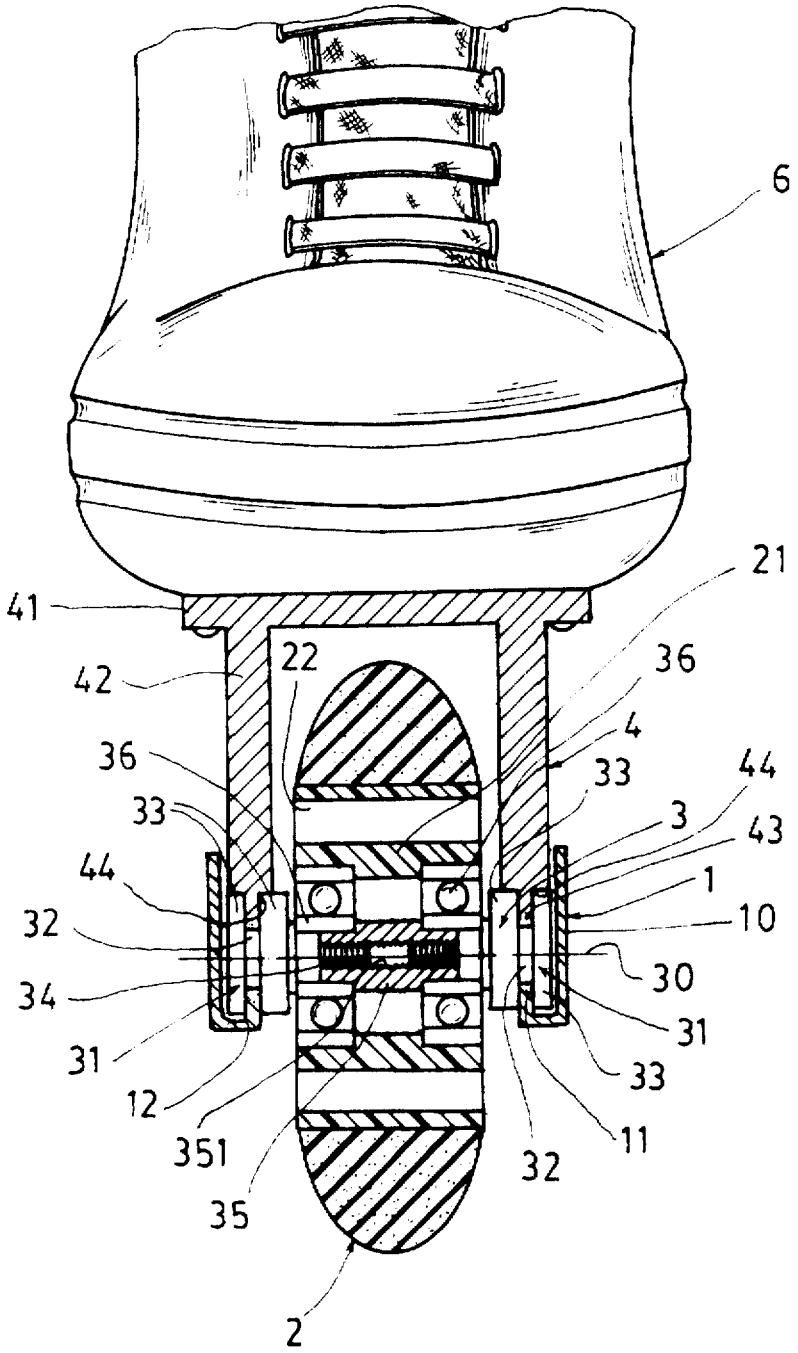
FIG. 2 is a longitudinal sectional drawing of the present invention as viewed across the axle means.
Figure 3:
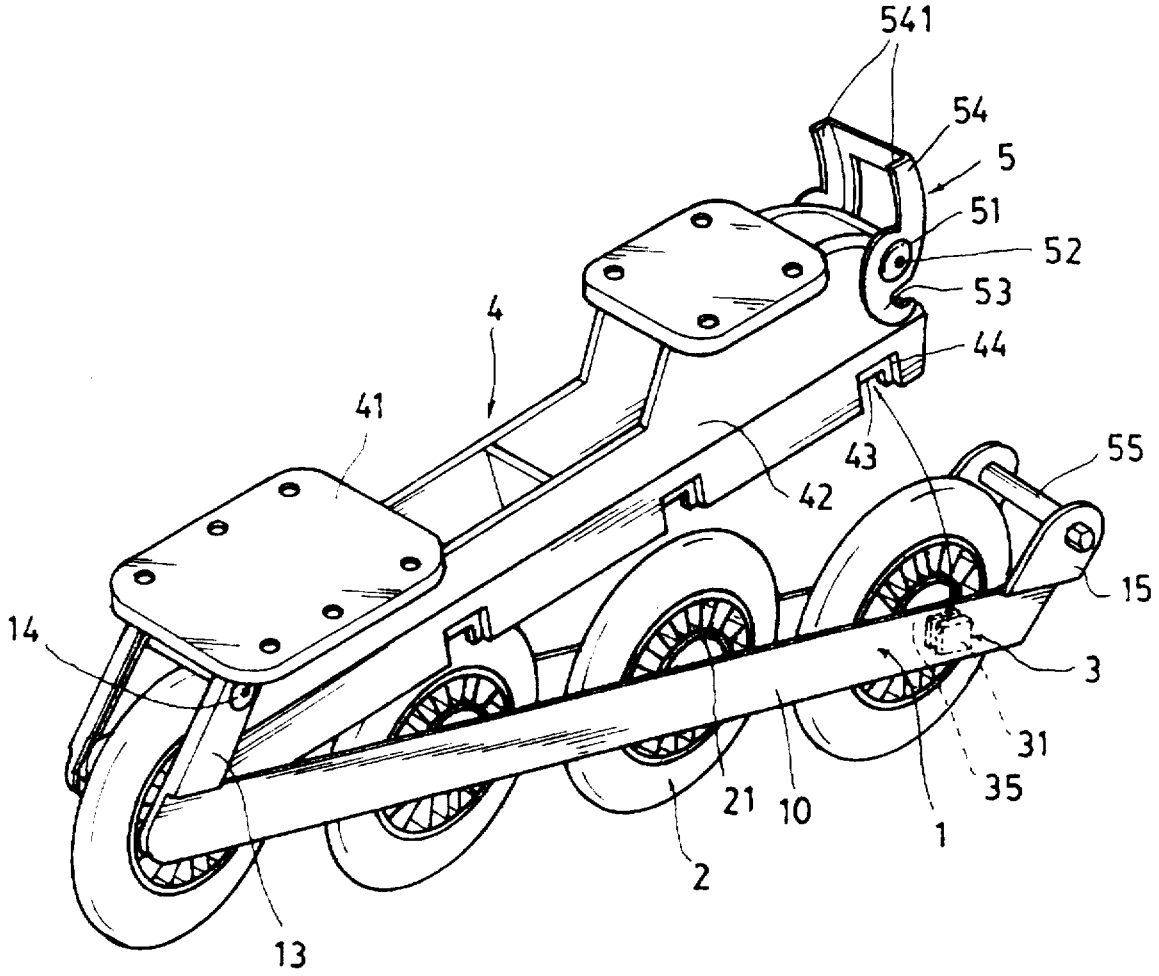
FIG. 3 is a perspective view when assembling the present invention.

As shown in FIGS. 1–5, a preferred embodiment of the detachable frame device for in-line roller skate comprises: a rack means 1, a plurality of wheels 2 rotatably mounted on the rack means 1 by a plurality of axle means 3, a chassis 4 pivotally connected with the rack means 1 and secured under a boot or shoe 6 of a roller skate or the like, and a locking means 5 for locking the chassis 4 with the rack means 1 for clamping the axle means 3 therebetween for rotatably securing each wheel 2 in the axle means 3.

The rack means 1 includes: a pair of elongated rack members 10 having a plurality of ribs 1*a* connected between the two rack members 10, a plurality of supporting extension portions 11 bent inwardly upwardly from each rack member 10 to be generally L shaped each supporting extension portion 11 having two lugs 11*a* disposed on two opposite ends of the supporting extension portion 11, a longitudinal groove 12 defined between the rack member 10 and the supporting extension portions 11, a pair of front brackets 13 each front bracket 13 protruding upwardly from a front end portion of each rack member 10 for pivotally connecting a front portion of the chassis 4 by passing a pivot 14 through a pair of pivot holes 131 formed through the two front brackets 13 and two front pivot holes 45 through the chassis 4, and a pair of rear brackets 15 each rear bracket 15 protruding upwardly from a rear end portion of each rack member 10 for transversely connecting a latch 55 of the locking means 5 by screws 551 on the rear brackets 15.

Each axle means 3 includes: a pair of holding disk members 31 each holding disk member 31 clamped between each rack member 10 and each elongated frame member 42 of the chassis 4, a screw portion 34 protruding inwardly from each disk member 31 to face the other screw portion 34 protruding inwardly from the other holding disk member 31, a shaft 35 defining an axle axis 30 about a center of the shaft 35 and having the two screw portions inserted and secured into two opposite portions of the shaft 35, and a pair of bearings 36 disposed on two opposite end portions of the shaft 35 for rotatably engaging the shaft 15 within the pair of bearings 36 which are fixed in two opposite side portions in a hub 21 of a spoke 22 of each wheel 2 for rotatably securing each wheel 2 about the shaft 35 of each axle means 3.

Each screw portion 34 is male threaded to be engageable with a female-threaded hole 351 formed in the shaft 35, whereby upon driving of each disk member 31, each screw portion 34 may be fixed into the shaft 35 or the screw portion 34 may be dismantled from the shaft 35.

Each holding disk member 31 includes: a pair of flanges 33, with a flange 33 engageable with the groove 12 formed in the rack member 10 and engageable with a flange recess 44 recessed in a lower portion of each elongated frame member 42 of the chassis 4, and a neck portion 32 sandwiched between the two flanges 33 and clamped by each rack member 10 and each frame member 42.

Figure 7:
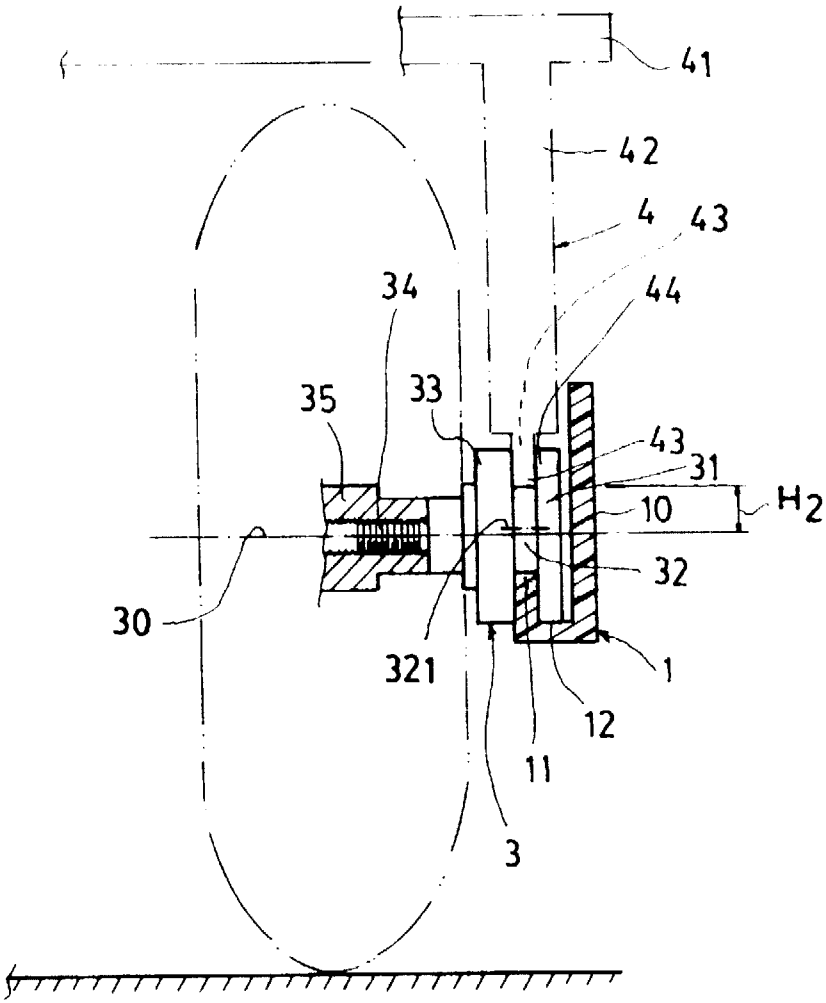
FIG. 7 shows the present invention at higher position than FIG. 6.
Figure 6:
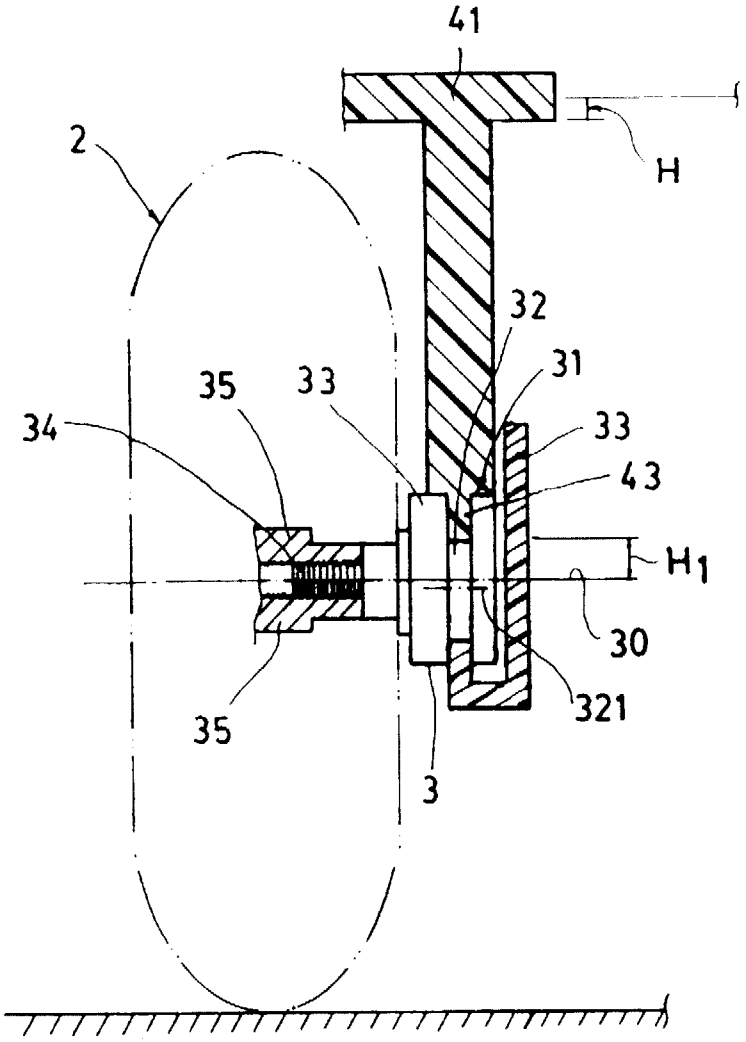
FIG. 6 is an illustration of the present invention with lower height.

The neck portion 32 of the holding disk member 31 is eccentric to the axle axis 30 of each axle means 3 especially as shown in FIGS. 6, 7 to have a first height H1 above the axle axis 30 when a neck portion axis 321 is lower than the axle axis 30 as shown in FIG. 6 or to have a second height H2 of the neck portion above the axle axis 30 when the axle means 2 is rotated for 180 degrees and when the neck portion axis 321 is higher than the axle axis 30 as shown in FIG. 7, thereby giving a height difference H when comparing the heights of chassis 4 between FIGS. 6 and 7.

The neck portion 32 may be formed as a rectangular shape or any other shapes, not limited in the present invention.

The chassis 4 includes: at least a platform portion 41 for securing a boot or a shoe 6 of a roller skate, a pair of elongated frame members 42 protruding downwardly from the platform portion 41 and having a plurality of ribs 4*a* transversely connected between the two frame members 42, a plurality of clamping extension portions 43 each protruding downwardly from a flange recess 44 recessed in a lower portion of the elongated frame member 42, with each flange recess 44 engageable with a flange 33 of each holding disk member 31 of the axle means 3, and the clamping extension portion 43 operatively holding the neck portion 32 of each disk member 31 in cooperation with a supporting extension portion 11 of the rack member 1 for firmly clamping each disk member 31 between the chassis 4 and the rack means 1 for rotatably mounting each wheel 2 on each axle means 2, a front pivot hole 45 formed in a front portion of each frame member 42 for pivotally connecting each rack member 10 by a pivot 14 inserted through the pivot hole 45, a rear pivot hole 46 for pivotally connecting the locking means 5 by a lever pivot 52 inserted in the rear pivot hole 46, and a rear convex portion 47 formed on a rear portion of the chassis 4 for engaging a lever 54 of the locking means 5 after actuating the locking means 5 for combining the chassis 4 with the rack means 1.

The locking means 5 includes: a base portion 51 having a lever pivot 52 passing through the base portion 51 and through a rear pivot hole 46 formed in the chassis 4 for pivotally connecting the base portion 51 on the chassis 4, a lever 54 protruding outwardly from the base portion 51 having a hook portion 53 formed on a lower portion of the base portion 51 opposite to the lever 54, and a latch 55 transversely secured on a pair of rear brackets 15 of the rack means 1 for engaging the hook portion 53 of the locking means 5 for coupling the chassis 4 and the rack means 1 for stably holding each axle means 3 between the chassis 4 and the rack means 1 for rotatably mounting each wheel 2 in each axle means 3.

Figure 4:
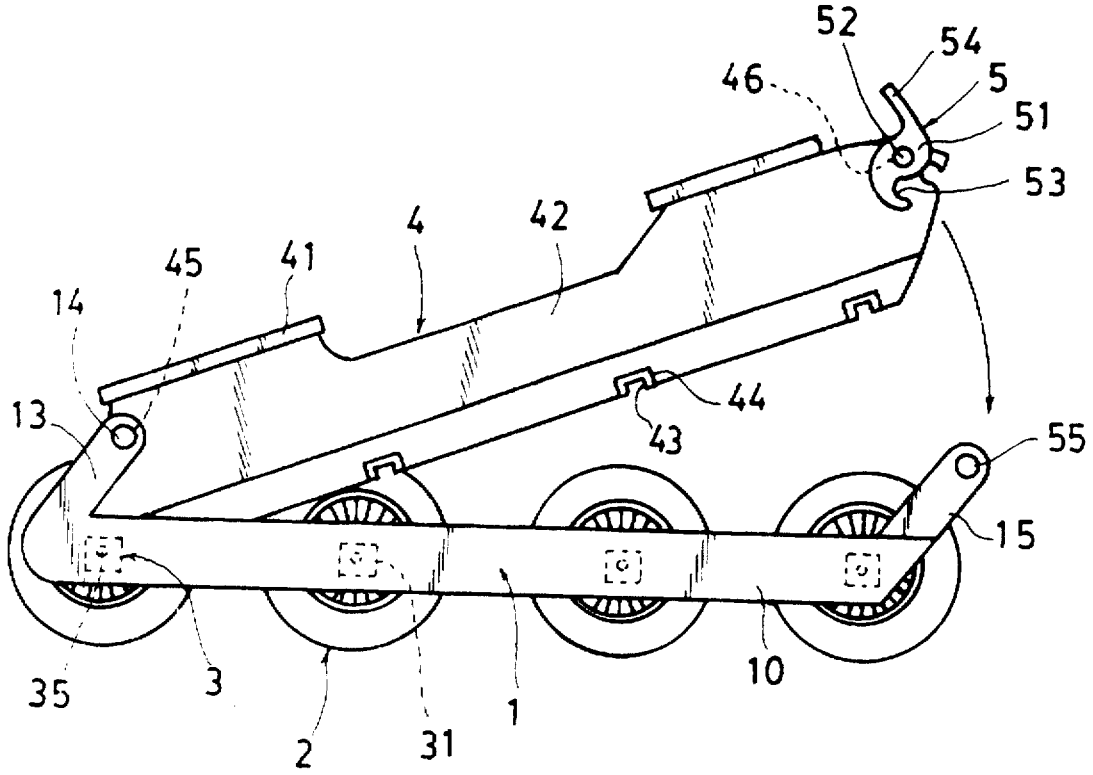
FIG. 4 is a front elevational view of the present invention.
Figure 5:
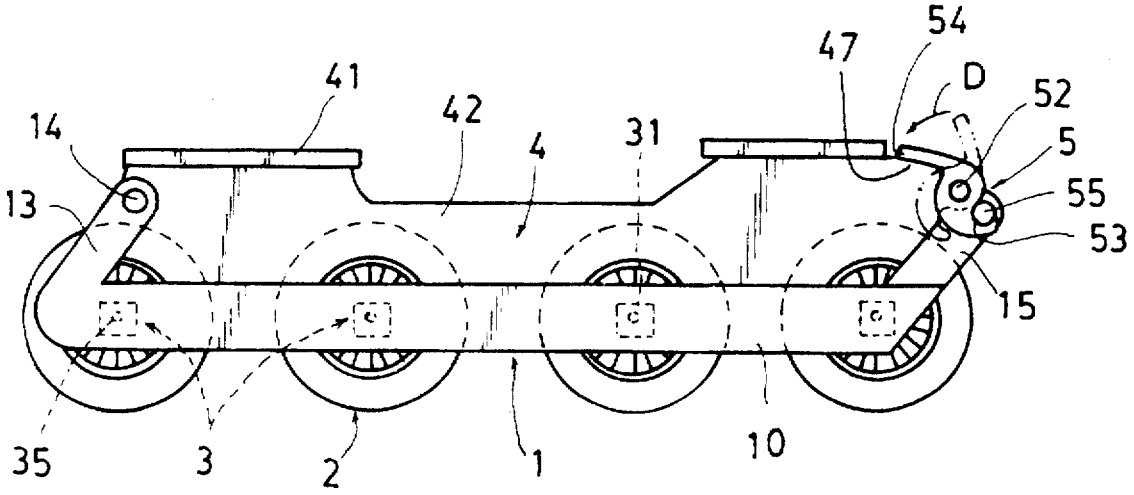
FIG. 5 is a front elevation of the present invention when assembled.

The lever 54 has a concave portion 541 recessed in an end portion of the lever 54 to be engageable with a rear convex portion 47 of the chassis 4 for stably positioning the lever 54 on the convex portion 47 (direction D) after actuating the locking means 5 for coupling the chassis 4 With the rack means 1 as shown from FIG. 4 to FIG. 5.

The pair of rack members 10 and frame members 42 may also be modified to be a single rack member 10 and a single frame member 42 for clamping each axle means 3, thereby forming a single cantilever arm for rotatably mounting a wheel on the single cantilever arm (not shown) protruding downwardly from the chassis 4.

The locking means 5 may also be formed on a front portion of the present invention, while the pivotal connecting mechanism between the chassis 4 and the rack means i may then be provided on the rear portion of the present invention.

Other modifications may be made in the present invention without departing from the spirit and scope of the present invention.

The present invention may be easily, instantly, conveniently dismantled for changing or replacing wheels 2 just by unlocking the locking means 5 and pivotally separating the chassis 4 from the rack means 1. Also, the holding disk member 31 of the axle means 3 may be rotated to change a height of the neck portion 32 clamped beteen the chassis 4 and the rack means 1, thereby selectively adjusting the different heights of the roller skate of the present invention for satisfying the player's interest.

I claim:

1. A frame device for in-line roller skate comprising: a rack means having a plurality of wheels linearly detachably mounted on the rack means, each said wheel rotatably secured on the rack means by an axle means detachably secured on the rack means, a chassis secured to a boot of the roller skate and pivotally secured to the rack means, and a locking means for locking the chassis with the rack means when each said axle means is clamped in between the chassis and the rack means, whereby upon unlocking of the locking means to separate the chassis from the rack means, said wheel and said axle means are removable from the rack means for replacing a new wheel.

2. A frame device according to claim 1, wherein said rack means includes: a pair of elongated rack members having a plurality of ribs connected between the two rack members, a plurality of supporting extension portions bent inwardly upwardly from each said rack member to be generally L shaped, each said supporting extension portion disposed with two lugs on two opposite ends of the supporting extension portion, a longitudinal groove defined between the rack member and the supporting extension portions, a pair of front brackets, each said front bracket protruding upwardly from a front end portion of each said rack member for pivotally connecting a front portion of the chassis by passing a pivot through a pair of pivot holes formed through the two front brackets and two front pivot holes formed through the chassis, and a pair of rear brackets, each said rear bracket protruding upwardly from a rear end portion of each said rack member for transversely connecting a latch of the locking means on the rear brackets.

3. A frame device according to claim 1, wherein each said axle means includes: a pair of holding disk members each said holding disk member clamped between each said rack member and the chassis, a screw portion protruding inwardly from each said disk member, a shaft defining an axle axis about a center of the shaft and having the two screw portions of the pair of holding disk members disposed on two opposite sides of the shaft and inserted into two opposite portions of the shaft, and a pair of bearings disposed on two opposite end portions of the shaft for rotatably engaging the shaft within the pair of bearings which are fixed in two opposite side portions in a hub of each said wheel for rotatably securing each said wheel about the shaft of said axle means.

4. A frame device according to claim 3, wherein said screw portion is male threaded to be engageable with a female-threaded hole formed in the shaft, whereby upon driving of each said disk member, each said screw portion is fixed into the shaft.

5. A frame device according to claim 3, wherein each said holding disk member includes: a pair of flanges, with each said flange engageable with a groove formed in the rack member and engageable with a flange recess recessed in a lower portion of the chassis, and a neck portion sandwiched between the two flanges and said neck portion clamped by a clamping extension portion of said chassis and a supporting extension portion of said rack member, said neck portion held on said supporting extension portion between two lugs formed on the supporting extension portion.

6. A frame device according to claim 5, wherein said neck portion of the holding disk member is eccentric to an axle axis of each said axle means to have a first height (H1) of said neck portion above the axle axis when a neck portion axis is lower than the axle axis, and to have a second height (H2) of said neck portion above the axle axis when the axle means is rotated for 180 degrees from the first height (H1) to allow the neck portion axis to be higher than the axle axis, thereby giving a height difference (H) for adjusting a height of the chassis.

7. A frame device according to claim 6, wherein said neck portion is formed as a rectangular shape.

8. A frame device according to claim 3, wherein said chassis includes: at least a platform portion for securing a boot of a roller skate, a pair of elongated frame members protruding downwardly from the platform portion and having a plurality of ribs transversely connected between the two frame members, a plurality of clamping extension portions each protruding downwardly from a flange recess recessed in a lower portion of the elongated frame member, with each said flange recess engageable with a flange of each said holding disk member of the axle means, and the clamping extension portion operatively holding the neck portion of each said disk member in cooperation with a supporting extension portion of the rack member for firmly clamping each said disk member between the chassis and the rack means for rotatably mounting each said wheel on each said axle means, a front pivot hole formed in a front portion of each said frame member for pivotally connecting each said rack member by a pivot inserted through the front pivot hole, a rear pivot hole formed in a rear portion of said chassis for pivotally connecting the locking means by a lever pivot inserted in the rear pivot hole, and a rear convex portion formed on a rear portion of the chassis for engaging a lever of the locking means after actuating the locking means for coupling the chassis with the rack means.

9. A frame device according to claim 8, wherein said locking means includes: a base portion having said lever pivot passing through the base portion and through said rear pivot hole formed in the chassis for pivotally connecting the base portion on the chassis, said lever protruding outwardly from the base portion having a hook portion formed on a lower portion of the base portion opposite to the lever, and a latch transversely secured on a pair of rear brackets of the rack means for engaging the hook portion of the locking means for coupling the chassis and the rack means for stably holding each said axle means between the chassis and the rack means for rotatably mounting a wheel in each said axle means.

10. A frame device according to claim 9, wherein said lever has a concave portion recessed in an end portion of the lever to be engageable with a rear convex portion of the chassis for stably positioning the lever on the convex portion after actuating the locking means for coupling the chassis with the rack means.

* * * * *